United States Patent [19]

Kanies

[11] Patent Number: 4,611,429

[45] Date of Patent: Sep. 16, 1986

[54] DOOR SEALING WEDGE

[76] Inventor: David E. Kanies, 815 N. Humboldt St., #401, San Mateo, Calif. 94401

[21] Appl. No.: 684,377

[22] Filed: Dec. 20, 1984

[51] Int. Cl.[4] ..... E06B 7/00

[52] U.S. Cl. ..... 49/70; 49/475; 15/257 R; 292/343

[58] Field of Search ..... 49/70, 475, 493, 495, 49/469, 485; 292/343; 15/257 R

[56] References Cited

U.S. PATENT DOCUMENTS 3,905,154 9/1975 Anderson ..... 49/485
4,178,717 12/1979 Sakauye ..... 49/475 X
4,449,267 5/1984 Siemion ..... 49/701 XZ

FOREIGN PATENT DOCUMENTS 581038 7/1933 Fed. Rep. of Germany ..... 49/495
1158659 7/1969 United Kingdom ..... 49/475

*Primary Examiner*—Kenneth Downey
*Attorney, Agent, or Firm*—T. R. Zegree

[57] ABSTRACT

A durable, resilient door wedge extending all along the entire width of the door is described. When squeezed into the space between the door edge and the floor, the wedge provides a seal thereby preventing a floor stripping solution from flowing onto floor area on the opposite side of the door.

13 Claims, 3 Drawing Figures

DOOR SEALING WEDGE

BACKGROUND OF THE INVENTION

This invention relates to an improved door sealing wedge. More particularly, the invention relates to a compressible wedge, the construction of which is adapted to prevent leakage of a stripping solution to the opposite side of the door when the wedge is inserted in operative position into the space between the bottom edge of the door and the floor surface.

Various types of short door stops designed to secure a door in any desired open position and thereby preventing it from swinging, as exemplified by U.S. Pat. No. 1,845,829 to Carnal, have been described in prior patents. Other types of devices adapted for sealing the gap between a door and the floor have been developed for attachment to the lower portion of the door. However, such devices interfere with the movement of the door from closed to open position. Furthermore, devices unattached to the door and adapted for sealing the gap between the door and the floor have been described in the patent literature. Thus, in U.S. Pat. No. 4,178,717 to Sakauye, a sealing device for placing beneath the door to prevent entry of noise, air, dust and other pollutants is disclosed. The U.S. Pat. No. 4,449,267 to Siemon describes a seal strip to be placed under the door to block the flow of floor stripping liquids. The latter device includes a sponge strip and an adhesive strip which is secured to the floor.

While the latter two above-mentioned patents disclose the general concept of a door sealing device, the wedge of this invention provides a new approach to the structural form of such device which offers certain advantages over the prior art devices.

OBJECTS OF THE INVENTION

In view of the foregoing, it is the principal object of the present invention to provide an improved wedge specifically adapted for sealing the space between a closed door and the floor thereby preventing leakage of a floor stripping liquid across such space to the adjoining floor area.

Another object of the invention is to provide an effective sealing device which is non-absorbent and adhesive-free and which is adapted to contain a solution employed in a floor stripping operation within the area to be stripped when squeezed into the space between a closed door and the floor.

A further object of the present invention is to provide a one-piece solid and firm yet resilient door sealing wedge which is not affixed to the bottom portions of a door but contacts it all along the width thereof in a frictional engagement with its edge thereby forming a liquid-tight barrier for passage of a stripping liquid therethrough.

Still another object of the invention is the provision of a unitary sealing wedge of the character described herein which can be manufactured in volume quantities at a low cost from readily available materials.

BRIEF SUMMARY OF THE INVENTION

These and other objects of the present invention will become more fully apparent from the following description taken in conjunction with the accompanying drawing.

In accordance with the invention, there is provided a resilient door sealing wedge specifically adapted for use in preventing leakage of a floor stripping liquid through a space between a closed door and the floor comprising a unitary, elongated body member having a horizontally extending front, rear and top projection, all interconnected by a central portion of said body member, said front projection having a leading end, an upper surface and a bottom surface sloping rearward from said leading end toward said central portion; said rear projection having a trailing end, an upper surface and a bottom surface sloping upward and frontward from said trailing end toward said central portion; said top projection extending generally upwardly having an upper end, a front surface and a rear surface sloping downward from said upper end toward said central portion, the length of said wedge being sufficient to seal said space.

BRIEF DESCRIPTION OF THE DRAWING

The invention will now be more fully described with reference to the accompanying drawing wherein like reference characters designate corresponding elements throughout the views thereof.

DETAILED DESCRIPTION OF THE INVENTION

Figure 1:
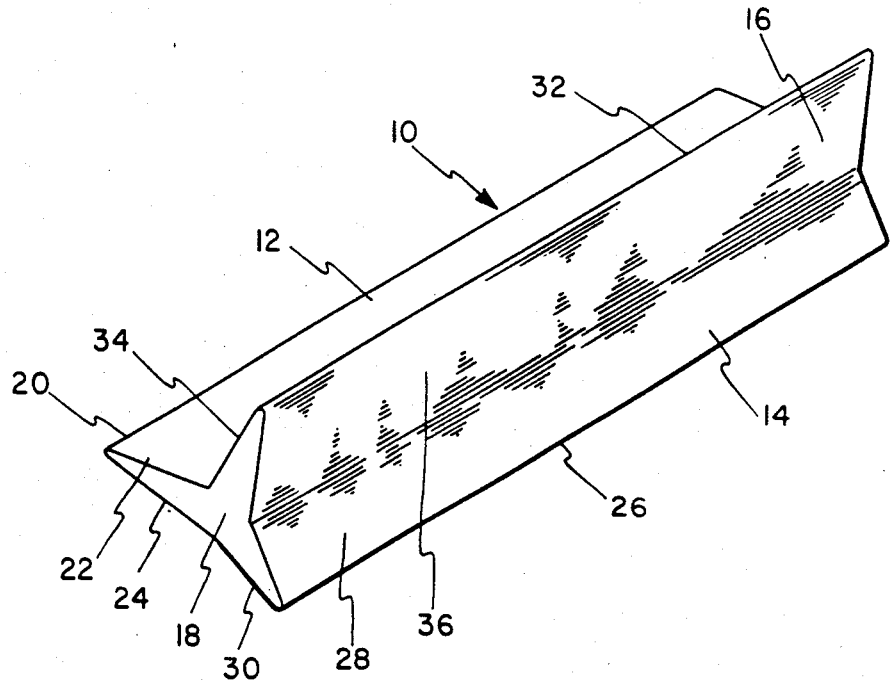
FIG. 1 is a perspective view of the sealing wedge of this invention.
Figure 2:
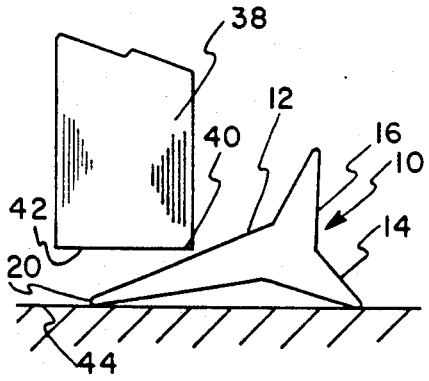
FIG. 2 is a side elevational view of the sealing wedge before its insertion into the space between the bottom edge of a door and the floor.
Figure 3:
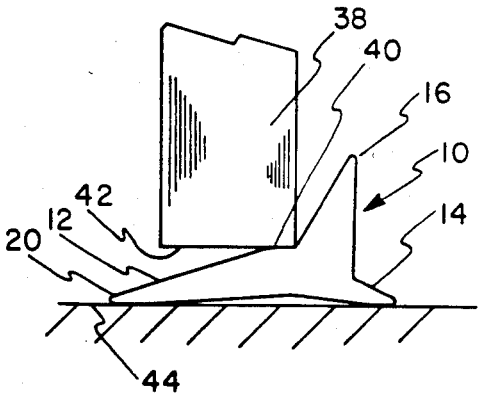
FIG. 3 is a view similar to that of FIG. 2 showing the sealing wedge in operative position in abutting engagement with the bottom edge of the door.

Referring now to the drawing, a firm but somewhat resilient unitary door sealing wedge 10, as illustrated in FIGS. 1 to 3, comprises a horizontally elongated body member having solid interior and comprising three outwardly extending projections of substantially equal length, i.e. a front projection 12, a ear projection 14 and a top projection 16, all three projections being of generally triangular configuration and integrally interconnected with central portion 18 of the body member. The front projection 12 includes a pointed leading tip or end 20 which is adapted for inserting and forward advancing the wedge 10 into the space between the bottom 42 of door 38 and the floor 44. Front projection 12 further includes upper surface 22 which slopes upward and rearward from end 20 toward central portion 18 at an angle of about 20° to 35° and bottom surface 24 likewise sloping upward and rearward from common end 20 toward central portion 18 at an angle of between about 5° and 15°, each angle being defined with respect to the horizontal.

The rear projection 14 is of substantially the same configuration as front projection 12, but shorter. It likewise comprises a pointed trailing end 26, an upper surface 28 inclined upward and frontward from end 26 to central portion 18 at an angle of about 25° to 45° and a bottom surface 30 inclined upward and frontward from end 26 to central portion 18 at an angle of about 10° to 20°. As illustrated in the drawing, the bottom surfaces 24 and 30 of front and rear projections 12 and 14 merge in the lower area of central portion 18 of wedge 10 forming jointly a continuous adhesive-free angular surface, the approximately mid-portion of which forms an obtuse angle of from about 130° to 170°, the apex of which being detached from the surface of the floor when wedge 10 is not positioned under a door.

However, upon placing wedge 10 in operative position by pressing it between the door bottom 42 and the floor 44, the two surfaces 24 and 30 tend to form almost a flat surface in contact with the floor, leaving in some instances a very small clearance therebetween depending on the amount of manual pressure exerted on rear surface 36 of top projection 16 while inserting wedge 10 under the door.

When disposed in operative position, bottom surface 30 of rear projection 14 contacting the floor forms a primary seal and bottom surface 24 of front projection 12 also contacting the floor forms a secondary, auxiliary seal between the door bottom 42 and the floor 44, while a portion of the upper surface 22 alone of front projection 12 is in abutting engagement with bottom edge 40 of door 38, the leading end 20 of front projection 12 extending beyond the bottom 42 of the door on the opposite side thereof. As shown in the drawing, the height of the upper portion of front projection 12 is greater than the space between door 38 and floor 44 and the length of front projection 12 is greater than that of rear projection 14.

The structure of top projection 16 is generally similar to that of projections 12 or 14. It comprises upper end 32, front surface 34 inclined frontward and downward toward central portion 18 of wedge 10 and rear surface 36 likewise inclined frontward and downward merging with the top portion of upper surface 28 of rear projection 14 to form an acute angle of from about 50° to 80° with the horizontal. The top projection 16 is remote from the vertical surface of door 38 when wedge 10 is positioned just prior to its insertion under the door, as shown in FIG. 2, or when squeezed into sealing engagement therewith, as shown in FIG. 3.

To position wedge 10 as an effective door seal, it is placed on the floor along the entire width of the bottom portion of the door, then advanced by applying manual pressure on rear surface 36 of top projection 16 until a satisfactory frictional engagement between the bottom 42 of door 38 and front projection 12 is achieved. Thus the function of rear surface 36 is to provide an area suitable for pushing wedge 10 to enhance a tight sealing action within the space between the door and the floor and to protect the lower portion of the door from being splashed upon during mopping of the stripping solution on the floor or during the subsequent machine scrubbing of the softened floor finish.

It will be understood that after front projection 12 has been properly inserted under the door in the operative position, the upper surface 22 of front projection 12 is flexed under pressure exerted by the edge 40 of the closed door 38 thereby insuring a snug, liquid-tight sealing contact between bottom edge 40 and the floor throughout the width of the door in addition to the initial sealing contact formed by rear projection 14 and the floor. After the stripping operation has been completed, the wedge 10 is easily removed from under the door and stored for reuse.

The wedge of the present invention may be fabricated from a single material, such as synthetic or natural rubber or any suitable rubber-like plastic material employed in the well known molding procedures. If desired, the wedge may be dyed in bright orange or yellow color to warn persons passing by that a stripping operation is in progress. The length of the wedge may vary within the range of about 30 inches to 48 inches or even longer, as long as it is sufficient to seal the entire space between a door and the floor.

It will be apparent from the foregoing description that I have devised an improved door sealing wedge having a body of substantially uniform configuration throughout its length and which is particularly useful for institutions requiring relatively frequent floor stripping, such as hospitals, schools, office buildings and the like. The wedge of my invention effectively prevents the passage of floor stripping solutions containing alkaline detergents and organic solvents under a door to the adjacent floor area and thus avoiding possible damage to floor finish or carpeting on the opposite side of the door. The wedge is characterized by novel structural features required for its basic function and by certain important properties, including compressibility under pressure, resistance to alkaline solutions and to organic solvents, non-absorbency and durability. Due to simplicity of its construction from a single material suitable for being integrally molded into a finished product, it may be manufactured inexpensively in a large volume.

It will be understood that various modifications in the form or in the constructional details of my invention as herein described in its preferred embodiment may be made without departing from the spirit thereof or the scope of the claims which follow.

I claim:

1. A resilient door sealing wedge for use in preventing leakage of a floor stripping liquid through a space between a closed door and the floor, comprising a unitary, unattached to said door, elongated body member having a horizontally extending front, rear and top projection interconnected by a central portion of said body member, said front projection having a leading end, an upper surface and a bottom surface sloping upward and rearward from said leading end toward said central portion; said rear projection having a trailing end, an upper surface and a bottom surface sloping upward and frontward from said trailing end toward said central portion; the bottom surfaces of said front and rear projections forming a continuous, adhesive-free, angular surface, the midportion thereof being detached from the floor surface; said top projection extending generally upwardly having an upper end, a front surface and a rear surface sloping downward from said upper end toward said central portion; the length of said wedge being sufficient to seal said space.

2. The wedge of claim 1 wherein the upper surface of said front projection is in abutting engagement with bottom edge of the door when said wedge is disposed in operative position.

3. The wedge of claim 1 wherein the leading end of said front projection extends beyond the bottom of the door when said wedge is disposed in operative position.

4. The wedge of claim 1 wherein the bottom surfaces of said front and rear projections merge in said central portion forming an obtuse angle.

5. The wedge of claim 4 wherein said obtuse angle is from about 130° to 170°.

6. The wedge of claim 1 wherein the bottom surface of said rear projection contacting the floor forms a primary seal and the bottom surface of said front projection contacting the floor forms a secondary seal between the door bottom and the floor.

7. The wedge of claim 1 wherein the bottom surfaces of said front and said rear projection form a substantially flat surface in contact with the floor when said wedge is disposed in operative position between the door edge and the floor.

8. The wedge of claim 1 wherein the rear surface of said top projection form an acute angle with the horizontal.

9. The wedge of claim 8 wherein said acute angle is from about 50° to 80°.

10. The wedge of claim 1 wherein said top projection is remote from vertical surface of the door when said wedge is disposed in operative position.

11. The wedge of claim 1 wherein said front projection is removably insertable by pressing said wedge into the space between the closed door and the floor to produce a sealing contact therebetween.

12. The wedge of claim 1 wherein the height of the upper portion of said front projection is greater than the space between the door and the floor.

13. The wedge of claim 1 wherein said front projection is longer than said rear projection.

* * * * *